United States Patent [19]

May et al.

[11] 4,398,911

[45] Aug. 16, 1983

[54] TANNING METHOD

[75] Inventors: Max May, Bottmingen, Switzerland; Rolf Monsheimer, Darmstadt; Ernst Pfleiderer, Darmstadt-Arheilgen, both of Fed. Rep. of Germany

[73] Assignee: Röhm GmbH, Darmstadt, Fed. Rep. of Germany

[21] Appl. No.: 354,202

[22] Filed: Mar. 3, 1982

Related U.S. Application Data

[63] Continuation of Ser. No. 169,847, Jul. 17, 1980, abandoned.

[30] Foreign Application Priority Data

Jul. 26, 1979 [DE] Fed. Rep. of Germany ..... 2930342

[51] Int. Cl.[3] ..... C14C 11/00; C14C 1/04; C14C 1/06; C14C 1/08

[52] U.S. Cl. ..... 8/94.16; 8/436; 8/437; 8/94.17; 8/94.19 R; 8/94.21; 8/94.27; 8/94.32; 8/94.33

[58] Field of Search ..... 8/94.16, 94.32, 94.33, 8/94.17, 94.19 R, 94.21, 94.27, 94.36, 437

[56] References Cited

U.S. PATENT DOCUMENTS

| | | | |
|---|---|---|---|
| 490,791 | 1/1893 | Mellinger | 8/94.16 |
| 1,976,679 | 10/1934 | Fikentscher et al. | 8/94.21 |
| 2,768,056 | 10/1956 | Kirk | 8/94.18 |
| 3,408,319 | 10/1968 | Rau | 260/23 AR |
| 3,850,575 | 11/1974 | Larsen | 8/94.18 |
| 3,945,792 | 3/1976 | Wurmli et al. | 8/94.21 |
| 3,986,926 | 10/1976 | Monsheimer et al. | 435/265 |
| 4,187,074 | 2/1980 | Träubel et al. | 8/94.19 R |
| 4,310,328 | 1/1982 | Monsheimer et al. | 8/94.16 |

FOREIGN PATENT DOCUMENTS

| | | | |
|---|---|---|---|
| 1930225 | 2/1970 | Fed. Rep. of Germany | 8/94.27 |
| 425201 | 3/1935 | United Kingdom . | |
| 433815 | 8/1935 | United Kingdom . | |
| 474991 | 11/1937 | United Kingdom . | |
| 585135 | 1/1947 | United Kingdom . | |
| 1172055 | 11/1969 | United Kingdom . | |
| 1407488 | 9/1975 | United Kingdom . | |
| 271704 | 9/1970 | U.S.S.R. | 8/94.18 |
| 507648 | 4/1976 | U.S.S.R. | 8/94.19 R |

*Primary Examiner*—Maria Parrish Tungol
*Attorney, Agent, or Firm*—Curtis, Morris & Safford

[57] ABSTRACT

What is disclosed are improved methods for the preparation of leather wherein, in one or more steps for preparing leather from animal skins or hides, including beamhouse operations such as soaking, dehairing, opening of the hide structure, deliming, bating, pickling, and degreasing to prepare dehaired tannable hides from animal skins or hides, and including subsequent tanning, retanning, and dying steps performed on said tannable hides, a thickening agent is added to at least one of the treating baths involved in such method steps.

5 Claims, No Drawings

TANNING METHOD

This is a continuation of application Ser. No. 169,847, filed July 17, 1980, now abandoned.

The present invention relates to an improved method for the preparation of leather.

Leather is prepared by working predominantly in an aqueous milieu. The preparation of the skin for tanning takes place in the so-called beamhouse. Hair, epidermis, and subcutaneous tissues must be removed since only the true corium with the papillary layer (grain) and reticular layer (support layer) can be used for the preparation of leather.

Treatment of the skins in the beamhouse as a rule encompasses the method steps of soaking, hair loosening, opening of the hide structure, and bating. The true tanning of the skin follows this. All these steps were developed during the course of long craft tradition and have to date undergone numerous improvements and adaptations to modern technology [cf. F. Stather, "Gerbereichemie und Gerbereitehnologie" ("Tanning Chemistry and Tanning Technology"), Akademie-Verlag, Berlin (1977)].

With ever-increasing urgency, ecological problems force themselves to the forefront of this technology. The scope of this problem can be measured, for example, by the fact that about 50 percent of the amount of raw skins delivered for the preparation of leather are lost as untanned or tanned wastes as well as with the waste water. Further, the waste water is contaminated by the chemicals which are added in the individual process stages and are in part not used [cf. Ullmann's "Encyclopaedie der technischen Chemie" ("Encyclopedia of Technical Chemistry"), 4th Edition, vol 16, Verlag Chemie, (1978), pages 126–127].

The consumption of water in the preparation of leather can, first, be significantly decreased by changing production from a still medium to an agitated medium. When working with rotating closed vats, one reckons with the use of about 25 $m^3$ of waste water per ton of weight of raw hides in comparison with about 75–125 $m^3/t$ when the hides are hung in pits and there is a gradual consumption of the baths using the countercurrent principle.

According to traditional technology, the waste water from soaking which contains the salt, used for conserving, dissolved out of the skin, in addition to suspended dirt and soluble protein; the baths containing liming residues—which contribute about 80 percent of the poisonous impurities (sulfide) which occur—; the remains of the deliming and bating baths with dissolved calcium and ammonium salts; the pickling baths; and, as the second most important component, the remains of the baths from chrome tanning with unconsumed chrome tanning materials, neutral salts; and still in addition the baths remaining from neutralization, retannage, dying and fat-liquoring all accumulate. Contrary to this technology is the demand to reduce the consumption of water, and thus the amount of waste water, to a minimum. Thus, the tendency is to work in the smallest amount of bath possible. Further, modern machine combinations (for example tanning drums or mixtures) were developed which permit a heating and recycling of the baths during the course of the process. New developments in the process brought further relief.

U.S. Pat. No. 3,986,926, incorporated herein by reference, recommends an enzymatic method for the preparation of dehaired skins ready for tanning, in which soaking, dehairing, opening of the hide structure, and bating are carried out in a single working operation (one step method). Nevertheless, even the face of these modern developments, the demand remains for a still more rational utilization of the water reserve. On the other hand, the quality of the products which are prepared cannot suffer under any circumstances.

It has now been found that the above-described methods for the preparation of leather from skins and hides can be carried out in an extremely small amount of bath if thickening agents (that is, organic high molecular weight materials which take up water and, on sufficient uptake of water, are converted into homogeneous, viscous fluid, solutions) are added during the known course of the methods. [cf. Roempp's "Chemielexikon", 7th Edition (1978) and Ullmann's "Encyclopaedie der technischen Chemie," 3rd Edition, Vol. 17, (1966) pages 107 and 192].

As thickening agents in the sense of the present invention, natural organic thickening agents such as agar-agar, carrageenin, tragacanth, gum arabic, alginates, pectins, guar flour, carob flour, starches, dextrins, glues, gelatin, and casein principally come into consideration. Further materials are modified organic natural materials, modified starches, starch derivatives, and starch decomposition products, cellulose derivatives—for example carboxyalkyl cellulose or cellulose ethers, hydroxyethyl cellulose and hydroxypropylmethyl cellulose and the like—, and carob flour ethers, as well as organic fully synthetic polymers such as polyacrylic compounds, polycarboxylic acids or their salts, vinyl polymers, polyethers, and polyamides. Finally, inorganic thickening agents such as polysilicic acids, clay minerals such as montmorillonite, zeolites, and others, come into consideration. To a certain degree, experience with thickening agents from other technical fields, for example from textile printing, can be brought in [cf. Milliand Textilberichte 5, 580 (1972) as well as Bayer Farben Revue 15, 64 (1968), op cit. 16, 53 (1968)].

Cellulose ether products, particularly methyl cellulose, ethyl cellulose, hydroxyethyl cellulose, hydroxypropylmethyl cellulose, and hydroxybutylmethyl cellulose have particular significance. The last-mentioned can be prepared, for example, by the action of ethylene oxide, of propylene oxide and methyl chloride, or of butylene oxide and methyl chloride, on cellulose under basic conditions. They are, for example, obtainable commercially under the tradenames "Methocel" or "Natrosor".

Further, anionic polyelectrolytes, particularly polymers comprising acrylic acid or methacrylic acid, as well as polymers of maleic acid or its anhydride and, to a lesser degree those of crotonic acid, itaconic acid, and others, optionally with the addition of other suitable monomers such as acrylamide and methacrylamide, esters of acrylic acid and methacrylic acid, for example the esters of $C_1$–$C_4$ alcohols such as methyl methacrylate, ethyl acrylate and butyl acrylate, as well as other polymerizable vinyl compounds such as styrene, heterocyclic vinyl compounds such as N-vinyl pyrrolidone, vinyl caprolactam, etc., preferably in the form of their alkali metal salts and ammonium salts, such as the sodium salts of polyacrylic acid, are of particular significance. It is to be understood that the choice of thickening agents takes into consideration the other parameters of the bath. Thus, the use of anionic polymers of the acrylate type is predominantly in the alkaline to neutral region. Both the use of soluble solid products as well as dispersions is contemplated. The thickening agents can also be used combined in a suitable fashion.

Suitable representatives of this class of acrylic compounds are commercially available, for example under the tradename "Rohagit". A survey of commercial thickening agents is given by H. Dahm in Bayer Farben Revue "Verdickungsmittel und Kleber fuer den Textildruck and verwandte Arbeitsgebiete" ("Thickening Agents and Adhesives for Textile Printing and Related Fields of Work"), special printing, 4th Edition, (1974). The technical treatment according to the present invention can be directed:

A. to the processes in the beamhouse involving the method steps of (a) soaking, (b) hair loosening and opening of the skin structure (liming or painting with lime), (c) deliming and bating, and (d) pickling, i.e. for the preparation of dehaired skins and hides, ready for tanning, and B. to the true tanning, particularly the process techniques of ($\alpha$) chrome tanning or ($\beta$) synthetic-vegetable fast tanning, and ($\gamma$) combination tanning, and C. to wet methods for dressing leather (i) neutralization of chrome leather, (ii) retannage of chrome leather, and (iii) dying and fat-liquoring of chrome leather.

The aforementioned method steps can be carried out in a very small amount of bath according to the present invention. The content of the thickening agents to be used according to the invention can vary within certain limits—depending on the individual thickening agents and their relative efficacy. The amount is in general rather small. As guiding values, amounts of thickening agents from 0.01 to 2 percent, preferably 0.03 to 1.2 percent, and especially preferred 0.03 to 0.35 percent, by weight of the total bath, are contemplated.

Otherwise, the method according to the present invention can be combined directly with the processes which now represent the state of the art, as will be shown with respect to the individual process steps. Thus, for example, thickening agents of the type earlier defined can advantageously be added to the soak, right from the beginning. However, the addition of thickening agent can also take place in every other beamhouse stage, thus also during hair loosening or in the opening of the hide structure, or on deliming and bating, or during pickling. One of the advantages of the method of the present invention lies in the possibility of proceeding with an adjusted small volume of bath. This advantage is particularly shown in the "one step process" according to U.S. Pat. No. 3,986,926. According to this, raw goods (skins and hides), free of conserving salt, are introduced into an aqueous bath having a pH between 9 and 12, which bath contains thickening agents of the aforementioned kind within the concentration region indicated, in addition to fungus proteases having an activity optimum at a pH greater than 7.0, bacterial proteases having an activity optimum at a pH greater than 9.0, an amine or an amine donor, and, optionally, an organic sulfur compound having a reducing effect.

The working steps of soaking, liming, etc. can be carried out in this manner with an amount of bath of about 30 to 50 percent water.

In this embodiment, the addition of about 0.5 percent by weight of the sodium salt of a polycarboxylic acid, particularly of a polyacrylic acid, and/or of methyl cellulose, has proved particularly advantageous. It must be viewed as particularly advantageous that liming waste water having a high protein contamination no longer arises according to the process of the invention. Because of the small amount of the bath, there is the possibility of separating the hair sludge from the waste water.

The advantages of the method according to the present invention also are expressed in following sub-section (b) of the beamhouse methods outlined above. Whereas until now the quantity of bath has had to be increased to 100–120 percent in order to achieve an opening of the hide structure after drumming of the hair when liming in a vat, this is no longer necessary when using the present method. The method steps of hair loosening and of opening the hide structure can be carried out, for example, in the soaking bath. By the use of thickening agents, hair loosening or hair jellification is accelerated and takes place more uniformly. The penetration of the collective liming chemicals occurs more rapidly. A slightly swollen dehaired hide which is not taut and which is free of grain contraction is obtained. By this "directed" opening of the hide structure, a favorable area yield is obtained, A "sueded" grain or grain damage because of friction during agitation were surprisingly not observed despite the use of the small amount of bath.

After carrying out the "one step method", thoroughly clean high quality dehaired hides free of contraction are obtained. Further, because of jellification of the hair and the swelling which occurs on opening of the hide structure, there is such a thickening of the bath that the bath takes on a highly viscous to slurry-like consistency. Such a bath can advantageously be worked up further, for example in analogy to the teachings of German patent publication 27 05 669. For example, it can be worked up into water-soluble hydrolysis products.

In the deliming and bating of beamhouse method sub-section (c), it is recommended in the technology employed until now to increase the amount of bath after a short treatment period in order to avoid grain damage by friction effects. When thickening agents are added according to the present invention, this is not necessary since this grain damage is avoided by such addition. Surprisingly it was learned that when thickening agents are added, the deliming effect and bating effect are reached after considerably shorter periods of time than heretofore. Apart from the shortening of the duration of the process, the procedure according to the present invention follows the methods representative of the state of the art.

Pickling and chrome tanning can be carried out according to the present procedure with amounts of bath of 20–40 percent (compared with common methods). In this way, contamination of the waste water by salts is reduced and absorption of the tanning materials is improved. Treatment times shorter than those used with conventional working methods are sufficient to achieve fastness to boiling.

In a cross-section, a more uniform distribution of chromium is observed. Even for skins of a heavy provenance, an astonishingly fine grain structure is achieved. The method step of pickling and chrome tanning according to the invention follows the methods representative of the state of the art.

In the procedure according to the invention, the usual difficulties which occur on synthetic-vegetable fast tanning are not observed. In this connection, grain damage due to friction effects on drumming in a small amount of bath, as well as problems in connection with through tanning and the distribution of tanning agent in heavy skin material, are particularly to be mentioned. Such problems are otherwise observed above all in the preparation of chamois leather of of sole leather having a thickness greater than 5 mm.

In the neutralization and retannage of chrome leather, a particularly rapid absorption of tanning materials is found, as well as a uniform coloration (as an expression of uniform pH-conditions) throughout the entire thickness of the leather when a cross-section is tested with bromcresol green solution. In the procedure of the invention, uniform, brilliant color tones are achieved on dyeing. A brightening of the color tone, as often occurs when synthetic tanning materials are employed, does not occur.

On fat-liquoring, a good absorption as well as a high degree of utilization of the bath are found. Also for the method steps of neutralization, of retannage of chrome leather, of dying, and of fat-liquoring, the corresponding method steps according to the state of the art can be referred to when proceeding according to the invention.

In the enzymatic method steps according to the present invention, additives for the enzymatic reaction such as activators, stabilizers, etc., known in the art, can be used. The proteolytic efficacy of enzymes is conventionally determined according to the Anson hemoglobin method [M. L. Anson, J. Gen. Physiol. 22, 79 (1939)], or according to the Loehlein-Volhard-Method ["die Loehlein-Volhard'sche Methods zur Bestimmung der proteolytischen Aktivitaet", "Gerbereichem. Taschenbuch", Dresden-Leipzig (1955)] in terms of "LVU" (Loehlein-Volhard units). By one Loehlein-Volhard Unit is to be understood that amount of enzyme which, under the specific conditions of the method, digests 1.725 mg of casein.

A better understanding of the present invention and of its many advantages will be had by referring to the following specific Examples, given by way of illustration.

EXAMPLE 1: SOAKING 150 salted black-variegated bull hides having a salt weight of 5,000 kg are washed in a vat with 150 percent of water at a feed temperature of 30° C. for two hours, with agitation from time to time. Thereafter, the bath is discarded.

Soaking follows with:

30.0 percent of water (25° C.),
0.02 percent of methyl cellulose,
0.01 percent of an anionic polyelectrolyte comprising acrylic acid ("Rohagit SL 147"), and
0.6 percent of caustic soda solution (30 percent).

The soaking period is six hours. Every hour, the batch is agitated for 15 minutes at ¾rpm.

After six hours, the skins are perfectly softened over their entire area and can be limed in the same bath. The percentages given are referred to the weight of the skin material treated (salt weight).

EXAMPLE 2: SOAKING, HAIR LOOSENING, AND OPENING OF THE HIDE STRUCTURE 150 salted, red-variegated cowhides having a salt weight of 5,000 kg are washed in a mixer for two hours with agitation from time to time for the removal of dirt, dung, and conserving salt using 80 percent of water at a feed temperature of 30° C. Thereafter, the bath is discarded. For soaking, a new bath is introduced comprising:

40 percent of water (25° C.),
0.05 percent of an aqueous dispersion of an acrylic resin ("Rohagit SL 147" or "Rohagit SD 15"),
0.01 percent of an alkaline bacterial protease (125,000 LVU), with pH-optimum at about 7,0
0.01 percent of a fungal protease (150,000 LVU)*, and
0.6 percent of caustic soda solution (30 percent). The soaking period is four hours. The batch is agitated for twenty minutes of every hour. The pH value of the soaking bath is 10.5 at the beginning and 9.5 at the end of the soak. After four hours, the skins are perfectly softened.

*with pH-optimum at about 9,0

For loosening the hair and opening the hide structure, the following are added to the soaking bath:

3.0 percent of hydrated lime,
1.0 percent of sodium sulfide (concentrated),
0.5 percent of sodium hydrogen sulfide (95 percent),
0.2 percent of sodium-2-mercapto ethanol,
0.2 percent of thioglycolic acid (85 percent),
0.4 percent of urea, and
0.5 percent of caustic soda (flakes).

All components are added at the beginning of the liming. The caustic soda is to be dissolved 1:5 in water before addition. On addition, the solution should not exceed 30° C. in order to avoid corrosive damage to the skin material. At the beginning of liming, the batch is agitated for two hours. The period of liming is 15–16 hours. During the night, the batch is agitated several times for five minute intervals. Before the mixer is emptied, the batch is agitated again for twenty minutes.

The dehaired skins which are obtained are completely free of hair, are thoroughly clean, and exhibit an aqueous swelling. Whereas when working without a thickening agent at this degree of loading of the container and with this amount of bath, grain contraction and grain damage in the form of "sueded" and/or abraded spots are observed in the dehaired hides, this phenomonom could not be detected when thickening agents are used. Since 50 percent of the bath is consumed by the swelling which occurs an opening of the grain structure, the possibility arises of separating hair sludge from the remaining residual bath which contains it in the form of a viscous, but not pourable solution. The addition of thickening agents during liming further leads to a dehaired hide which is not smooth and for this reason does not tend to slip during the mechanical steps of fleshing and cleaving which follow the liming. The percentages given for the soaking and liming chemicals pertain to the weight of the raw material introduced.

EXAMPLE 3: DELIMING AND BATING

The bath contains:

15.0 percent of water (30° C.),
0.1 percent of hydroxypropylmethyl cellulose,
0.02 percent of carob bean flour, 0.8 percent of ammonium chloride, and 0.4 percent of sodium bisulfite.

The treatment time is 20 minutes. For bating, the following are then added:

0.03 percent of trypsin (250,000 LVU), and 0.9 percent of ammonium sulfate.

The process is carried out for a further 40 minutes. The final pH value in the bath is 8.2. A test for deliming effect on a cross section of the dehaired skin using phenolphthalein solution reveals that the two exterior thirds of the hide are colorless and the interior third is red colored. The dehaired skins are free of dirt, scud, and short hairs at the end of the bating. They are permeable to air and have a very fine grain structure in which no drumming damage can be observed even on examination with a lens, despite the small amount of bath. The diffusion of the chemicals takes place rapidly and uniformly. The percentage values pertain to the weight of the materials introduced (dehaired skins).

EXAMPLE 4: CHROME TANNING 1000 kg of delimed and bated goatskins are first washed in a vat with 150 percent of water (25° C.) for 20 minutes. The bath is then discarded.

Pickle: 20 percent of water (20° C.), 0.1 percent of hydroxyethyl cellulose.

Agitate for 20 minutes and add 3.0 percent of sodium chloride.

Agitate for 10 minutes and add 0.4 percent of sulfuric acid (technical, 98 percent, diluted 1:10).

Agitate for 30 minutes. The pH value of the bath is 3.4–3.6.

CHROME TANNING:

Chrome tanning follows in the pickling bath with addition of 6.0 percent of an organic masked chrome tanning agent having a $Cr_2O_3$-content of 30 percent and a basicity of 50 percent.

The treatment time is 6 hours. The pH value of the bath at the end of treatment is 3.7.

Using this method employing a small amount of bath containing hydroxethyl cellulose, the penetration of the chemicals in the pickle and the chrome tanning is considerably accelerated. Thus, in the pickle a uniform, bright green-colored skin cross-section is observed after a treatment time of only 30 minutes. The leather was stable to boiling after a treatment time of six hours. It shows no grain damage. The percentage values pertain to the amount of skin material treated (dehaired hides).

EXAMPLE 5: SYNTHETIC VEGETABLE FAST TANNING 3,000 kg of washed, delimed, and bated cowhides are added to the bath residue remaining in the vat, together with:

10.0 percent of a synthetic tanning material comprising a phenol-formaldehyde-condensation product with a tanning agent content of about 40 percent, 0.05 percent of hydroxybutylmethyl cellulose, and 0.2 percent of sulfated train oil, emulsified 1:5.

Agitate for one hour and add 0.8 percent of formic acid (technical, 85 percent, diluted 1:5).

Treatment is continued for a further hour. The pH value of the bath is 4.3.

Testing of the leather cross-section with a solution of bromcresol green shows uniform green coloration, uniform tanning, and uniform acidification.

Complete tanning follows with:

10.0 percent of quebracho extract (powder).

Treat for one hour and add:

10.0 percent of mimosa extract (powder), 1.0 percent of a synthetic dispersable tanning agent comprising a condensation product of aromatic sulfonic acids and formaldehyde, 0.2 percent of sulfated train oil (emulsified 1:5), and 10 percent of water (20° C.).

Treat for a further hour and add:

10.0 percent of mimosa extract (powder) and 20.0 percent of water, (20° C.).

Treatment is continued for seven hours.

The final temperature of the bath should be 35° C. The leather remains overnight in the tanning bath. It is advantageous to agitate for 5 to 10 minutes from time to time. Before the leather is removed, it is recommended that it be washed for one to two hours with 200 percent of water at 25° C.

By the use of hydroxybutylmethyl cellulose, the distribution and uniform diffusion of the tanning agents into the leather cross-section is significantly accelerated. This is evident from the short operational times between the individual additions. Whereas normally the through-tanning of heavy materials without the addition of thickening agents leads to difficulties and can often not be attained even using long treatment times, such problems are not observed when cellulose ethers are employed.

After finishing, the leather has a uniform bright color, a soft hand, and shows no grain damage. The percentage values are referred to the weight of the skin material introduced in a dehaired condition (dehaired weight). The amount of tanning agents refer to trade goods and not to pure tanning agents.

EXAMPLE 6: NEUTRALIZATION, RETANNAGE, DYEING, AND FAT-LIQUORING FOR UPPER LEATHER FROM COWHIDES 3,000 kg of shaved chrome leather skin halves are first washed in a tanning machine with:

50 percent of water (25° C.) and 0.5 percent of sodium formate.

The treatment time is 20 minutes. The bath is subsequently discarded.

NEUTRALIZATION 15.0 percent of water (25° C.), 1.0 percent of neutralization tanning agent, and 0.06 percent of hydroxypropylmethyl cellulose are introduced.

The batch is agitated for 20 minutes. The pH value of the bath is 4.8.

DYEING 1.0 percent of anionic leather dye are added and the batch is agitated for 20 minutes.

FAT-LIQUORING 7.0 percent of an anionic emulsifiable fat-liquoring agent for leather comprising synthetic or animal crude fat is added. The fat-liquoring agents are emulsified with water at 60° C. in a ratio of 1:5 before addition.

The treatment time is 20 minutes.

The auxiliary agents are taken up by the leather more rapidly and uniformly. The amount of accumulated waste water is minimal. The finished leather has a soft hand, is very uniformly dyed, and has an extraordinarily fine grain structure. The percentage amounts are referred to the weight of the leather (shaved weight).

EXAMPLE 7: VAT-DYEING 1,000 kg of shaved chrome tanned calf leather are neutralized according to the conventional working method. Dying follows in a fresh bath with:

20 percent of water (50° C.) and
0.2 percent of methyl cellulose.

Agitate for 10 minutes and add:

0.5 percent of a 1:1 metal complex dyestuff.

Agitate for 20 minutes.

Fat-liquoring can be done in the same bath. The absorption of the dye into the leather takes place more rapidly than usual. Before the leather is removed, a washing step should be introduced.

The finished leather shows a brilliant uniform dyeing. Also, the wash water is practically free of dye residues. The percentage figures refer to the weight of the treated leather (shaved weight).

EXAMPLE 8: FAT-LIQUORING OF LEATHER FOR CLOTHING

Starting material: pickled dehaired sheepskins. The pickled dehaired skins are first chrome-tanned in the usual way. Retannage, neutralization, and dyeing follow.

Fat-liquoring is carried out in a fresh bath with:

50 percent of water (60° C.),
4 percent of sulfated wool fat,
2 percent of sulfated sperm oil, and
4 percent of an anionic synthetic leather fat-liquoring agent.

Agitate for 10 minutes and add 0.04 percent of hydroxyethyl cellulose

Agitate for 10 minutes.

After this period of time, the fat-liquoring agent is completely absorbed. After a brief washing, the leather can be taken from the vat. The percentage figures pertain to the partially dry weight.

EXAMPLE 9: DEGREASING

For degreasing, 1,000 kg of sheepskins were bated and pickled and then thoroughly drained. Draining can take place either by dripping or by pressing off the water. Degreasing followed in a vat with:

3.0 percent of ethoxylated nonylphenol,
0.2 percent of hydroxymethyl cellulose, and
0.2 percent of odorless petrol ether The skins are drummed for 60 minutes.

Washing follows with:

500 percent of water (35° C.).

Washing is carried out for 30 minutes. The washing process is repeated twice, after which the fat emulsion is completely removed.

After tanning, leather with a clean readily dyable grain and a soft hand is obtained.

The percentage figures pertain to the weight of material which in this case is equal to the weight of the dehaired skins.

EXAMPLE 10: DELIMING OF GOAT SKINS 2,000 kg of unhaired goat skins are delimed with:

30 percent of water (30° C.),
2.0 percent of ammonium chloride, and
0.05 percent of cellulose methylhydroxyethylether.

The skins are agitated for 20 minutes.

Even after this short period of time, the unhaired skins are fully delimed throughout. They show no red coloration when tested with phenolphthalein solution.

The subsequent bating can be carried out in the same bath.

The percentage figures for the chemicals are referred to the weight of material which, in this case, is the weight of the unhaired skins.

EXAMPLE 11: RETANNAGE OF LEATHER FOR SHEEPSKIN CLOTHING

Sheepskins having a trimmed weight of 2,000 kg are retanned in a vat with:

30 percent of bath (50° C.),
0.2 percent of hydroxypropylmethyl cellulose, and
6.0 percent of emulsified fat.

The skins are agitated for 30 minutes. The following is added to the bath:

4.0 percent of glutardialdehyde (25 percent diluted 1:5).

The batch is again agitated for 30 minutes.

The skins are now rinsed for 10 minutes with running water at 30° C.

After storage overnight, the skins are partially dried.

Very soft sweat-resistant leather was obtained which could be readily dyed.

The percentage figures refer to the weight of the material which in this case is the same as the trimmed weight.

Instead of the "Rohagit" materials, mentioned earlier herein, acrylate dispersions commercially available under the tradenames "Rohagit SD 15", "Rohagit S-ENV", "Rohagit S-NV", "Rohagit MV", and "Rohagit S-HV" can be used with the same good results.

What is claimed is:

1. In a process for the preparation of leather from skins or hides, which process includes beamhouse method steps for the preparation of dehaired hides ready for tanning as well as the subsequent method steps of tanning and dressing said dehaired skins or hides, the improvement wherein a cellulose ether is added to the treating bath used in at least one of said method steps.

2. A process as in claim 1 wherein said cellulose ether is added in an amount from 0.01 to 2 percent by weight of the total weight of the bath to which it is added.

3. A process as in claim 1 wherein said cellulose ether is added in an amount from 0.03 to 1.2 percent by weight of the total weight of the bath to which it is added.

4. A process as in claim 1 wherein said cellulose ether is added in an amount from 0.03 to 0.35 percent by weight of the total weight of the bath to which it is added.

5. A process as in claim 1 wherein said cellulose ether is selected from the group consisting of methyl cellulose, hydroxyethyl cellulose, hydroxypropylmethyl cellulose, and hydroxybutylmethyl cellulose.

* * * * *